US006575565B1

(12) United States Patent
Isono et al.

(10) Patent No.: US 6,575,565 B1
(45) Date of Patent: Jun. 10, 2003

(54) PIEZO-ELECTRIC ACTUATOR OF INK JET PRINTER HEAD AND METHOD FOR PRODUCING SAME

(75) Inventors: Jun Isono, Nagoya (JP); Atsuhiro Takagi, Kariya (JP); Masatomo Kojima, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 245 days.

(21) Appl. No.: 09/671,338

(22) Filed: Sep. 27, 2000

(30) Foreign Application Priority Data

Sep. 30, 1999 (JP) ..... 11-278828
Aug. 28, 2000 (JP) ..... 2000-258007

(51) Int. Cl.[7] ..... B41J 2/045

(52) U.S. Cl. ..... 347/71

(58) Field of Search ..... 347/68–72

(56) References Cited

U.S. PATENT DOCUMENTS 5,402,159 A * 3/1995 Takahashi et al. ..... 347/9
5,639,508 A * 6/1997 Okawa et al. ..... 427/100
5,912,526 A * 6/1999 Okawa et al. ..... 310/328
2001/0030490 A1 * 10/2001 Wajima et al. ..... 310/366
2002/0051042 A1 * 5/2002 Takagi et al. ..... 347/72

* cited by examiner

*Primary Examiner*—Judy Nguyen
(74) *Attorney, Agent, or Firm*—Oliff & Berridge, PLC

(57) ABSTRACT

An actuator for the print head of an ink jet printer is fitted to the ink channels of the head. The actuator includes an active layer and a restraining layer. One side of the active layer faces the ink channels. The active layer can deform with a drive voltage applied to it. The restraining layer is provided on the other side of the active layer, and cannot be activated with a drive voltage. The restraining layer restrains the active layer from deforming. It is possible to integrally form the active and restraining layers by stacking green sheets and calcining the stacked sheets at the same time. This makes it possible to provide an actuator simple in structure and low-cost.

11 Claims, 11 Drawing Sheets

PIEZO-ELECTRIC ACTUATOR OF INK JET PRINTER HEAD AND METHOD FOR PRODUCING SAME

BACKGROUND OF THE INVENTION

1. Field of the Invention

The present invention relates to the piezo-electric actuator of the print head of an ink jet printer and a method for producing such an actuator.

2. Description of Related Art

The print head of a known ink jet printer has ink channels and piezo-electric elements provided adjacently to them. The ink jet printer performs printing a print by applying a voltage to the piezo-electric elements to reduce the volume of one or more of the ink channels, ejecting ink from this channel or these channels through an orifice or orifices.

FIG. 11 of the accompanying drawings shows the print head of a conventional ink jet printer, which is disclosed in the Assignee's U.S. Pat. No. 5,402,159, for example. This print head includes a piezo-electric actuator 103, which is provided over ink ejectors 90*a*, 90*b* and 90*c*. The piezo-electric actuator 103 includes five piezo-electric ceramic sheets or layers 40 laminated or stacked together. An internal negative electrode 42 lies on the upper side of each of the top, middle and bottom ceramic sheets 40. Separate internal positive electrodes 44*a*, 44*b* and 44*c* lie on the upper side of each of the other two ceramic sheets 40. The positive electrodes 44*a*, 44*b* and 44*c* are provided over or above the ink ejectors 90*a*, 90*b* and 90*c*, respectively. The ink ejectors 90*a*, 90*b* and 90*c* have ink channels 32*a*, 32*b* and 32*c*, respectively, and orifices 37*a*, 37*b* and 37*c*, respectively. This print head consists of a small number of parts and is simple in structure. It is easy to make the resolution of the print head higher by varying the electrode pattern. The use of the laminated piezo-electric actuator 103 results in lower drive voltage.

A deformation restraining member 80 is bonded to restrain the piezo-electric actuator 103 from deforming away from the ink channels 32*a*–32*c*. This makes it possible to deform the piezo-electric actuator 103 effectively toward the ink channels 32*a*–32*c* and consequently drive the ink ejectors 90*a*–90*c* at lower voltage. This also makes it possible to reduce the cross talk at each ink channel 32*a*, 32*b* or 32*c* which is caused by the deformation of the adjacent ink channel or channels due to irregular deformation of the piezo-electric actuator 103. The cross talk reduction improves the SN ratio (S/N).

The process for producing this print head includes alternately stacking, pressing and calcining the piezo-electric ceramic sheets 40 and the internal electrodes 42 and 44*a*–44*c*, and thereafter bonding the deformation restraining member 80 with an adhesive or the like. This complicates the process, increases the number of steps of the process, and raises the production cost.

SUMMARY OF THE INVENTION

In view of the foregoing problems, it is an object of the present invention to provide a piezo-electric actuator for an ink jet printer head which makes it possible to reduce cross talk, restrain the laminated piezo-electric element of the print head from deforming away from the ink channels of the head, and which can be assembled simply and produced at a low cost. It is another object to provide a method for producing such an actuator.

In accordance with a first aspect of the present invention, a piezo-electric actuator is provided for an ink jet printer head which has an ink channel and an orifice, and which ejects ink from the channel through the orifice by changing the volume of the channel. The actuator includes an active layer and a restraining layer. One side of the active layer faces the ink channel. The active layer includes at least one sheet formed out of piezo-electric material and provided with an electrode thereon. The restraining layer is positioned on the other side of the active layer, and restrains the active layer from deforming. The restraining layer includes at least one sheet. The active and restraining layers are sintered to be integral with each other.

The active layer is interposed between the ink channel and the restraining layer, which is formed integrally with the active layer. The restraining layer restrains the active layer from deforming. This makes it possible to efficiently utilize the deformation of the active layer to change the volume of the ink channel. It is therefore possible to improve the ink ejecting performance of the print head and reduce power consumption. This also makes it possible to prevent deformation in parallel to the layers to restrain the volume change of the ink channel or channels adjacent to a driven ink channel. It is therefore possible to prevent cross talk.

The active and restraining layers are formed by being integrally sintered. Consequently, in comparison with the case where a deformation restraining member is bonded with an adhesive or the like, it is possible to reduce the number of steps of the process for producing the piezo-electric actuator. This simplifies the producing process and lowers the production cost. It is also possible to increases the strength of the actuator.

The sheets of the active and restraining layers may be formed out of the same material. In this case, members for forming the active layer can be used as they are for the restraining layer. This makes it possible to produce the piezo-electric actuator simply at a lower cost. The same material makes the layers fit together, and prevents them from being warped, distorted or deformed, when they are integrally sintered. This results in high accuracy or precision.

The sheet of the restraining layer may be provided with a dummy electrode, which does not contribute to the deformation for driving the ink channel. In this case, when the active and restraining layers are integrally sintered, it is possible to equalize the differences in shrinking percentage in the directions perpendicular to the layers to prevent warps and/or waves due to the difference in shrinking percentage between the layers. This can made the piezo-electric actuator very flat. Consequently, the actuator can be bonded closely to the cavity layer in which the ink channel is formed. This results in high accuracy or precision.

The dummy electrode of the restraining layer may be connected to the electrode of the active layer, and face this electrode through a ceramic, which is a dielectric. In this case, there is no potential difference between the dummy electrode and the electrode of the active layer, producing no electric capacity between them. As a result, no electric power is wasted.

The dummy electrode of the restraining layer and the electrode of the active layer may be positioned in substantial symmetry in the piezo-electric actuator. In this case, when the active and restraining layers are integrally sintered, it is possible to roughly equalize the differences in shrinking percentage in the directions perpendicular to the layers to prevent warps and/or waves due to the difference in shrinking percentage between the layers. This can make the piezo-electric actuator even flatter. Consequently, the actuator can be bonded closely to the cavity layer. This results in high accuracy or precision.

In accordance with a second aspect of the present invention, a piezo-electric actuator is provided for an ink jet printer head. The actuator includes a laminate including a plurality of piezo-electric sheets stacked and sintered at the same time. The actuator also includes an electrode formed on at least one of the sheets which is positioned on one side of the laminate. Only said at least one sheet on the one side is adapted for activation with a drive voltage. At least one of the sheets which is positioned on the other side of the laminate is not adapted for activation (deactivated). This actuator is simple in structure and therefore very easy to produce.

In accordance with a third aspect of the present invention, a print head is provided for an ink jet printer. This print head includes an ink ejector having an ink channel formed therein and an orifice through which ink can be ejected from the channel. The print head also includes a piezo-electric actuator for changing the volume of the ink channel. The actuator includes an active layer and a restraining layer. One side of the active layer faces the ink channel. The active layer includes at least one sheet formed out of piezo-electric material and provided with an electrode thereon. The restraining layer is positioned on the other side of the active layer, and restrains the active layer from deforming. The restraining layer includes at least one sheet. The active and restraining layers are sintered to be integral with each other. The print head includes a piezo-electric actuator according to the invention, and is therefore highly reliable and low-cost.

In accordance with a fourth aspect of the present invention, a method is provided for producing a piezo-electric actuator for an ink jet printer head. The method comprises the steps of:

providing at least one first green sheet having an electrode pattern, the first green sheet being formed out of piezo-electric material and forming an active layer of the actuator;

laying at least one second green sheet on the first green sheet, the second green sheet forming a restraining layer of the actuator; and calcining the first and second green sheets at the same time to be integral with each other.

This producing method involves forming the active layer and the restraining layer by calcining them. The restraining layer restrains the active layer from deforming away from the ink channels of the print head. It is therefore possible to efficiently utilize the deformation of the active layer to change the volume of the ink channels. This makes it possible to improve the ink ejecting performance of the print head and reduce power consumption. It is also possible to prevent the horizontal or lateral deformation of the active layer to restrain the volume change of the ink channel or channels adjacent to a driven ink channel, preventing cross talk. In particular, the active and restraining layers are formed by being integrally sintered. Accordingly, in comparison with the case where a deformation restraining member is stuck with an adhesive or the like, the piezo-electric actuator can be produced at a low cost by a simple process including a reduced number of steps, and its strength can be high.

The second green sheet, too, may be formed out of the piezo-electric material. A plurality of first green sheets and a plurality of second green sheets may be provided. The producing method may further comprise the step of providing at least part of the second green sheets with a dummy electrode or dummy electrodes. The second green sheets may include a sheet provided with a dummy electrode and a sheet provided with no dummy electrode. In this case, the restraining layer includes a sheet provided with a dummy electrode, which does not contribute to deformation, and a sheet provided with no dummy electrode. Therefore, when the active and restraining layers are integrally sintered, it is possible to equalize in balance the differences in shrinking percentage in the directions perpendicular to the layers to prevent warps and/or waves due to the difference in shrinking percentage between the layers. This can made the piezo-electric actuator very flat.

The second green sheet without a dummy electrode may be laid on the second green sheet provided with a dummy electrode. In this case, the restraining layer includes a sheet having no dummy electrode and laid on a sheet provided with a dummy electrode, which does not contribute to deformation. Therefore, when the active and restraining layers are integrally sintered, the dummy electrode can restrain the electrode pattern on the active layer from diffusing, and it is possible to equalize in balance the differences in shrinking percentage to prevent warps, making the piezo-electric actuator very flat.

The producing method may further comprise the steps of pressing with heat and then degreasing the first and second green sheets before calcining them.

DETAILED DESCRIPTION OF PREFERRED EMBODIMENTS

Figure 1:
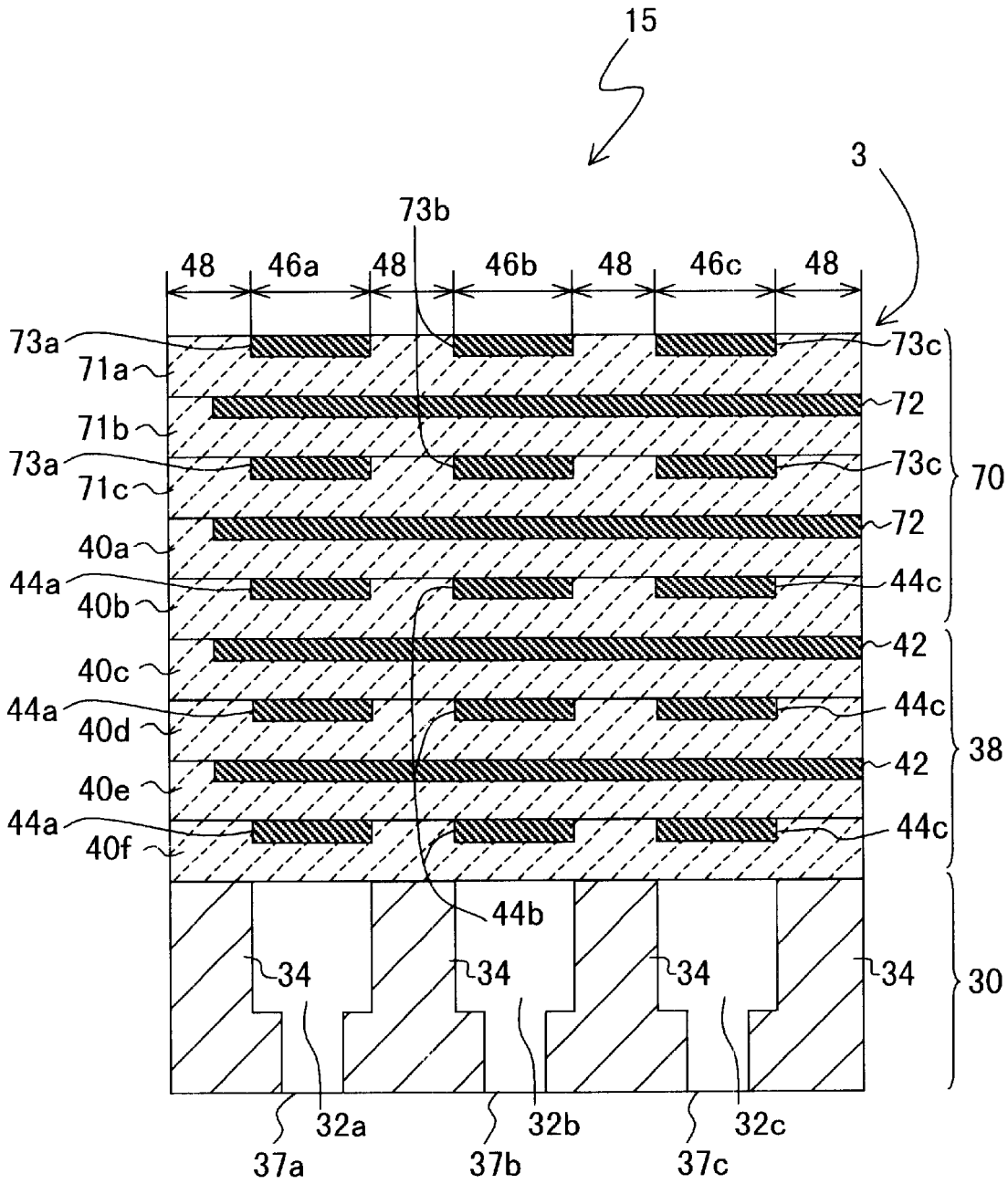
FIG. 1 is a vertical cross section of main parts of the print head of an ink jet printer embodying the present invention.

FIGS. 1–6 show a preferred embodiment of the present invention. The parts and/or components of the embodiment which are identical and/or equivalent to the counterparts of the prior art are assigned the same reference numerals without being described.

Figure 6:
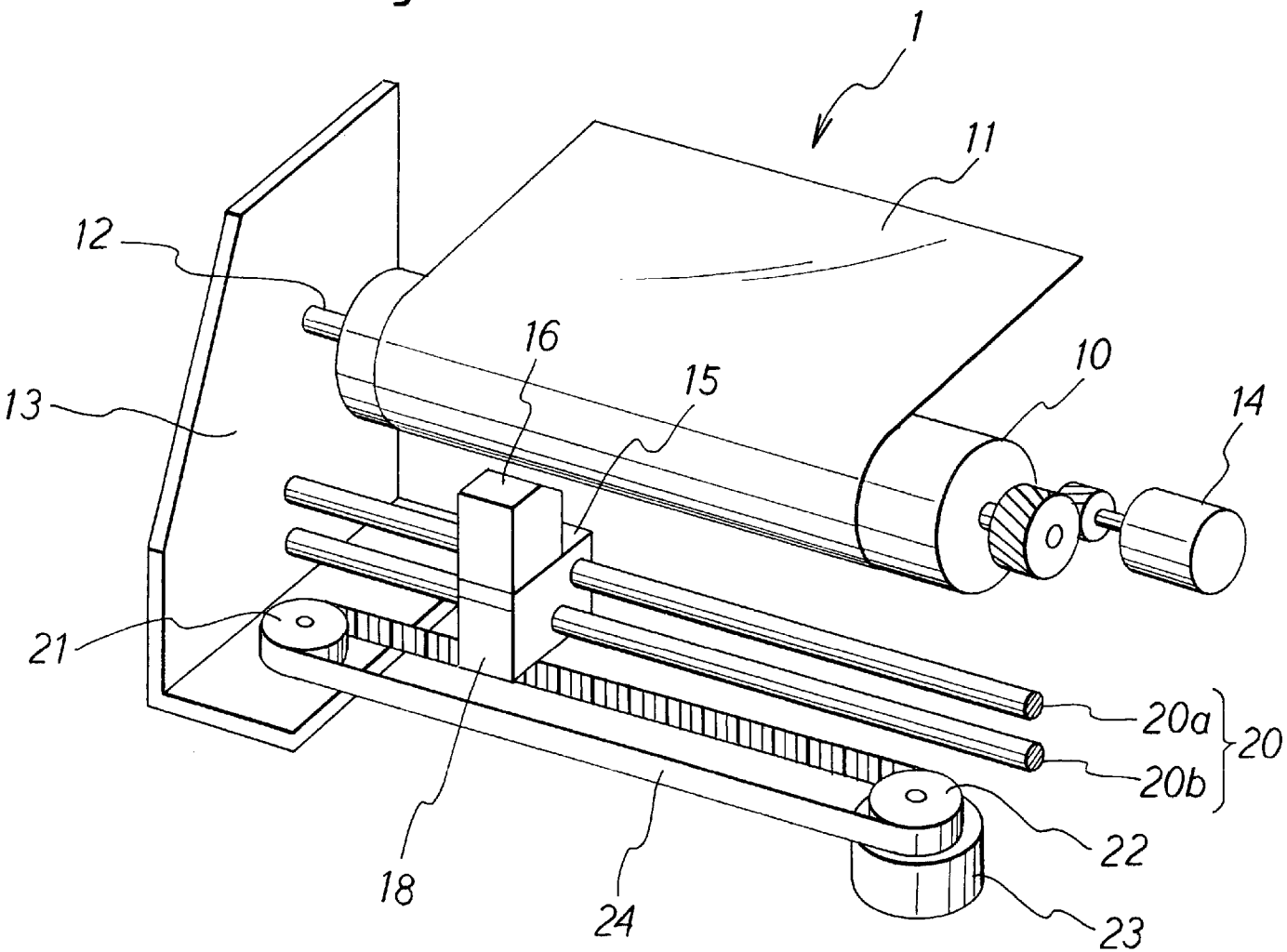
FIG. 6 is a perspective view of main parts of the ink jet printer.

With reference to FIG. 6, an ink jet printer 1 includes a horizontal platen 10 for feeding printing paper 11 perpendicularly to its axis. The platen 10 includes a shaft 12, which is supported rotatably by a frame 13, and can be rotated by a motor 14 through a drive gear train.

A pair of guide rods 20 (20*a* and 20*b*) extend below the platen 10 and in parallel to its shaft 12, and are fixed to the frame 13. The guide rods 20 slidably support a carriage 18, which is connected to a timing belt 24. The timing belt 24 extends between a driven pulley 21 and a driving pulley 22, which can be rotated by a motor 23 to drive the timing belt 24. The carriage 18 supports a print head 15 and an ink supply device 16 on it. Thus, the timing belt 24 can slide the carriage 18 on the guide rods 20 along the platen 10, with the print head 15 facing the platen 10.

With reference to FIG. 1, the print head 15 (FIG. 6) includes a cavity layer 30 and a piezo-electric actuator 3, which consists of an active layer 38 and a restraining layer 70. The cavity layer 30 has three ink channels 32*a*, 32*b* and 32*c* formed in it and each having an open top. The cavity layer 30 also has three orifices 37*a*, 37*b* and 37*c* formed through its bottom and communicating with the ink channels 32*a*, 32*b* and 32*c*, respectively. The active layer 38 lies on the top of the cavity layer 30. The active layer 38 includes six piezo-electric ceramic sheets 40*a*, 40*b*, 40*c*, 40*d*, 40*e* and 40*f* laminated or stacked together and each having an electrode pattern formed on their upper sides. The piezo-electric ceramic sheets 40*a*–40*f* each have an electrostrictive strain effect. The electrostrictive strain effect of the active layer 38 changes the volume of the ink channels 32*a*, 32*b* and 32*c* to eject through the orifices 37*a*, 37*b* and 37*c*, respectively, the ink stored in these channels. The restraining layer 70 lies on the top of the active layer 38 and is formed integrally with the active layer. The restraining layer 70 includes three ceramic sheets 71*a*, 71*b* and 71*c* laminated or stacked together. The restraining layer 70 restrains the active layer 38 from deforming upward when the active layer is driven. The restraining layer 70 makes the whole actuator 3 more rigid to prevent cross talk.

Figure 5:
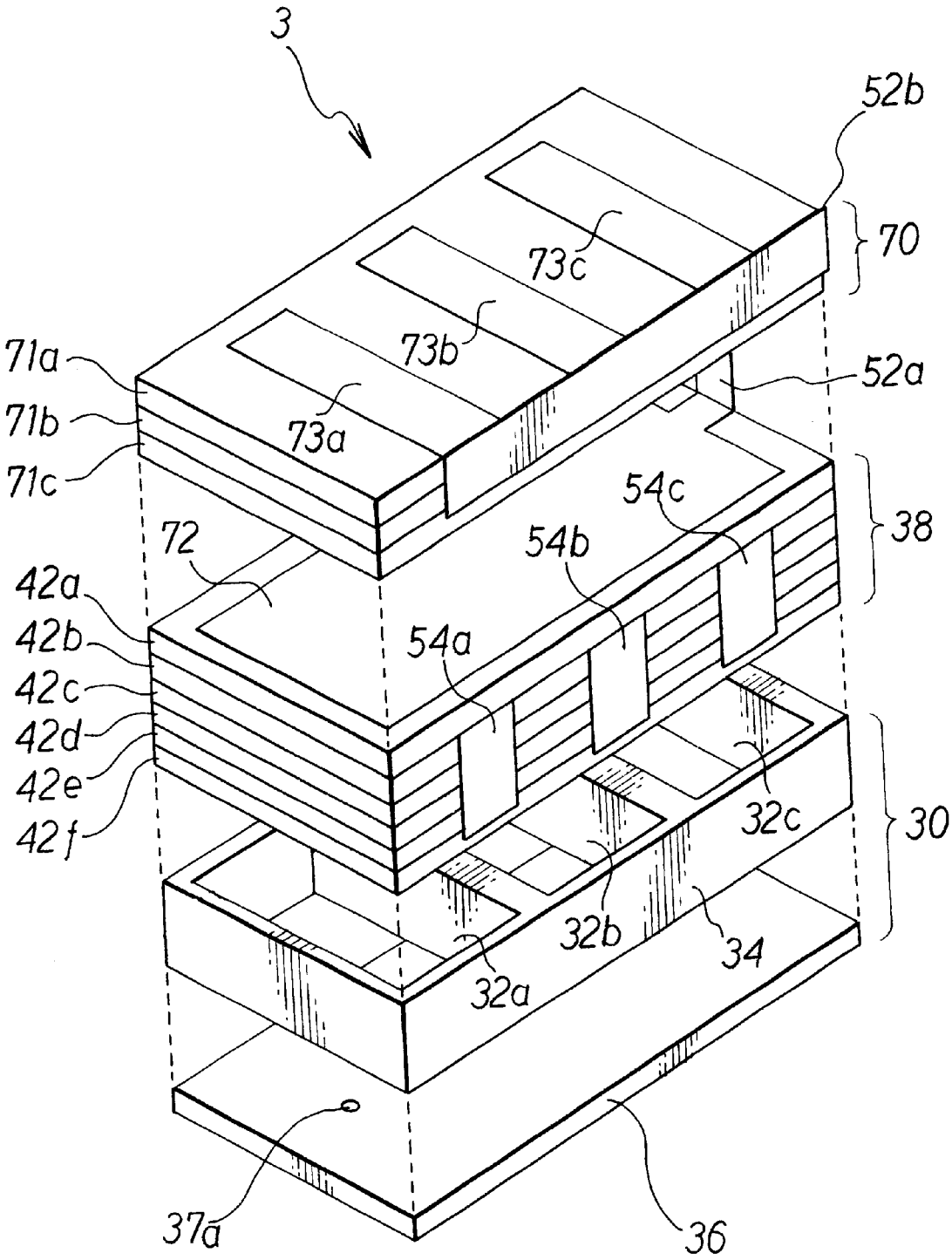
FIG. 5 is an exploded perspective view of the main parts of the print head.

As shown in FIG. 5, the cavity layer 30 includes a channel body 34 and an orifice plate 36, which covers the bottom of the channel body. The orifices 37*a*–37*c* are formed through the orifice plate 36. The channel body 34 is a rectangular parallelepiped, in which the ink channels 32*a*, 32*b* and 32*c* are formed in parallel and spaced at regular intervals. Each of the ink channels 32*a*–32*c* has a width of about 250 microns and a height of 60 microns. The channel body 34 and the orifice plate 36 are made of irony material and bonded together. Otherwise, the channel body 34 and orifice plate 36 might be integrally molded by calcining ceramics or the like, or injection-molding alumina or similar material.

Each of the ink channels 32*a*–32*c* is filled always with ink by being supplied through a supply passage (not shown) communicating with the ink supply device 16 (FIG. 6). A negative pressure is applied to the ink in the ink channels 32*a*–32*c* so that the surface tension of ink produces concave menisci of ink in the orifices 37*a*–37*c*. This normally prevents ink from leaking through the orifices 37*a*–37*c*, but allows ink to be ejected through them only when the internal pressure in the ink channels 32*a*, 32*b* and 32*c* rises. Each ink supply passage is fitted with a check valve (not shown) for preventing ink from flowing back to the ink supply device 16 when the internal pressure in the associated ink channel rises.

The orifices 37*a*–37*c* might be replaced by nozzles extending from the respective ink channels 32*a*–32*c*. The nozzles could be angled to adjust the direction of ejection from the ink channels 32*a*–32*c*. The orifices 37*a*–37*c* might be positioned elsewhere than the bottoms of the ink channels 32*a*–32*c*.

Figure 4:
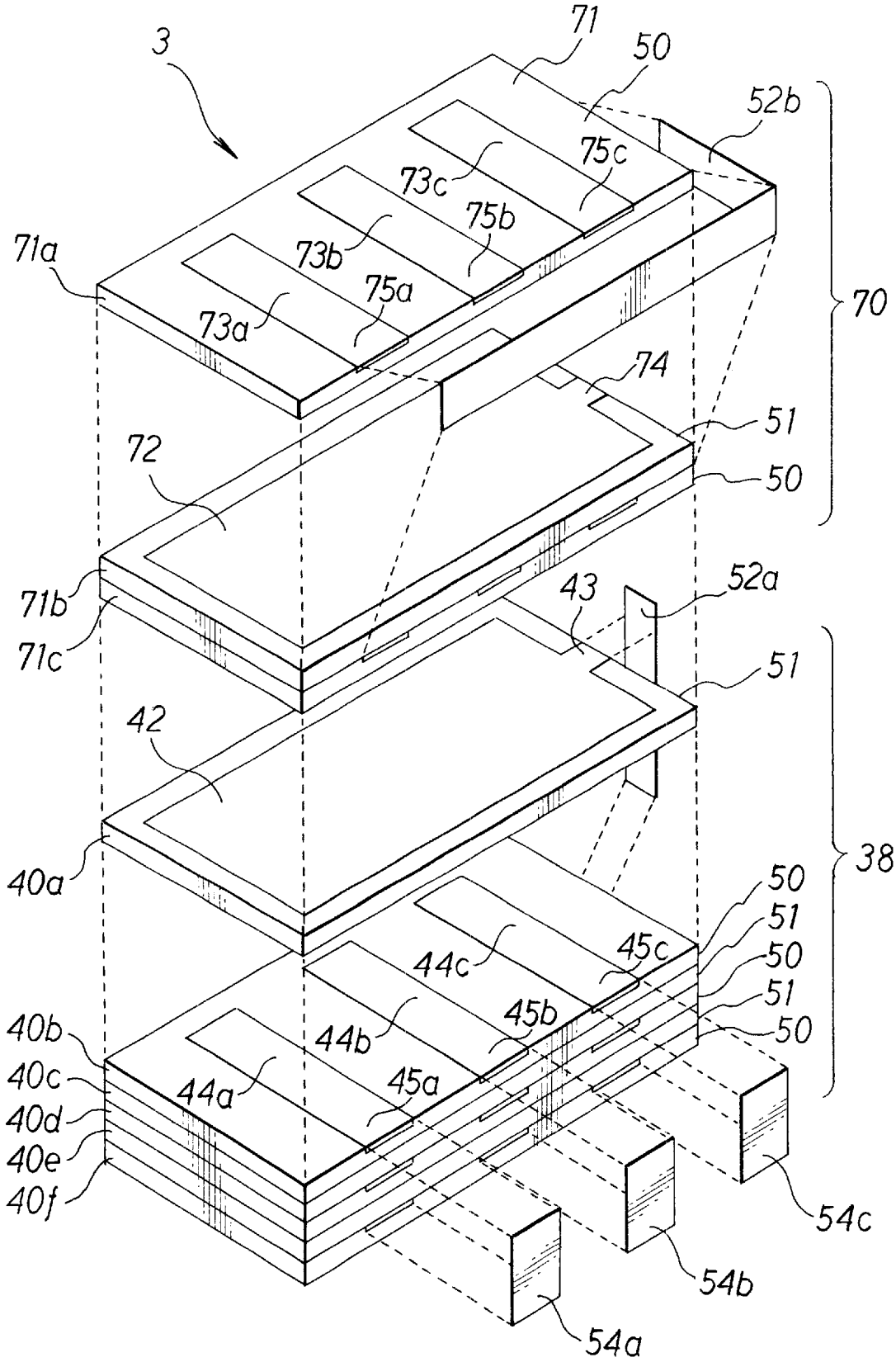
FIG. 4 is an exploded perspective view of the piezo-electric actuator.

As best shown in FIG. 4, each of the three piezo-electric ceramic sheets 40*a*, 40*c* and 40*e* of the active layer 38 has an internal negative electrode 42 and a connector 43 which are formed on its upper side as stated later on. The connector 43 connects the negative electrode 42 electrically to the outside. The negative electrode 42 covers the substantial portion except a peripheral portion of the upper side of the associated piezo-electric ceramic sheet 40*a*, 40*c* or 40*e*.

Likewise, each of the other three piezo-electric ceramic sheets 40*b*, 40*d* and 40*f* of the active layer 38 has three internal positive electrodes 44*a*, 44*b* and 44*c* and three connectors 45*a*, 45*b* and 45*c* formed on its upper side. The connectors 45*a*, 45*b* and 45*c* electrically connect the positive electrodes 44*a*, 44*b* and 44*c*, respectively, to the outside. The positive electrodes 44*a*, 44*b* and 44*c* are associated with the ink channels 32*a*, 32*b* and 32*c* (FIG. 5), respectively, and extend in parallel. Each of the positive electrodes 44*a*–44*c* takes the form of a belt or band and has a width of about 120 microns.

The internal negative and positive electrodes 42 and 44*a*–44*c* are made of Ag—Pd metallic material and each have a thickness of about 2 microns. The piezo-electric ceramic sheets 40*a*–40*f* with the two types of electrode patterns printed on them are alternately laminated or stacked.

Thus, as shown in FIG. 1, one internal negative electrode 42 is positioned on one side of each of the five piezo-electric ceramic sheets 40*a*–40*e*, while three internal positive electrodes 44*a*–44*c* are positioned on the other side of each of these sheets and one side of the bottom piezo-electric ceramic sheet 40*f*. Each of the six piezo-electric ceramic sheets 40*a*–40*f* consists of piezo-electrically active portions 46*a*, 46*b* and 46*c* and piezo-electrically inactive portions 48. Each of the active portions 46*a*–46*c* of the five sheets 40*a*–40*e* is formed between the adjacent negative electrode 42 and one of the adjacent positive electrodes 44*a*–44*c*, each of which takes the form of a belt or band. Each of the active portions 46*a*–46*c* of the bottom sheet 40*f* is formed under one of the adjacent positive electrodes 44*a*–44*c*. Each of the active portions 46*a*–46*c* has a width of about 120 microns. The other portions of the six piezo-electric ceramic sheets 40*a*–40*f* are the inactive portions 48. When voltage is applied between the positive electrodes 44*a*, 44*b* or 44*c* and the negative electrodes 42, electric fields are generated in the associated active portions 46*a*, 46*b* or 46*c*, which then deform vertically due to the electrostrictive strain effect, while no electric field is generated in the inactive portions 48, which do not deform. The channel body 34 is fixed to the bottom of the active layer 38 in such a manner that the active portions 46*a*, 46*b* and 46*c* are positioned over or above the ink channels 32*a*, 32*b* and 32*c*, respectively.

Figure 2:
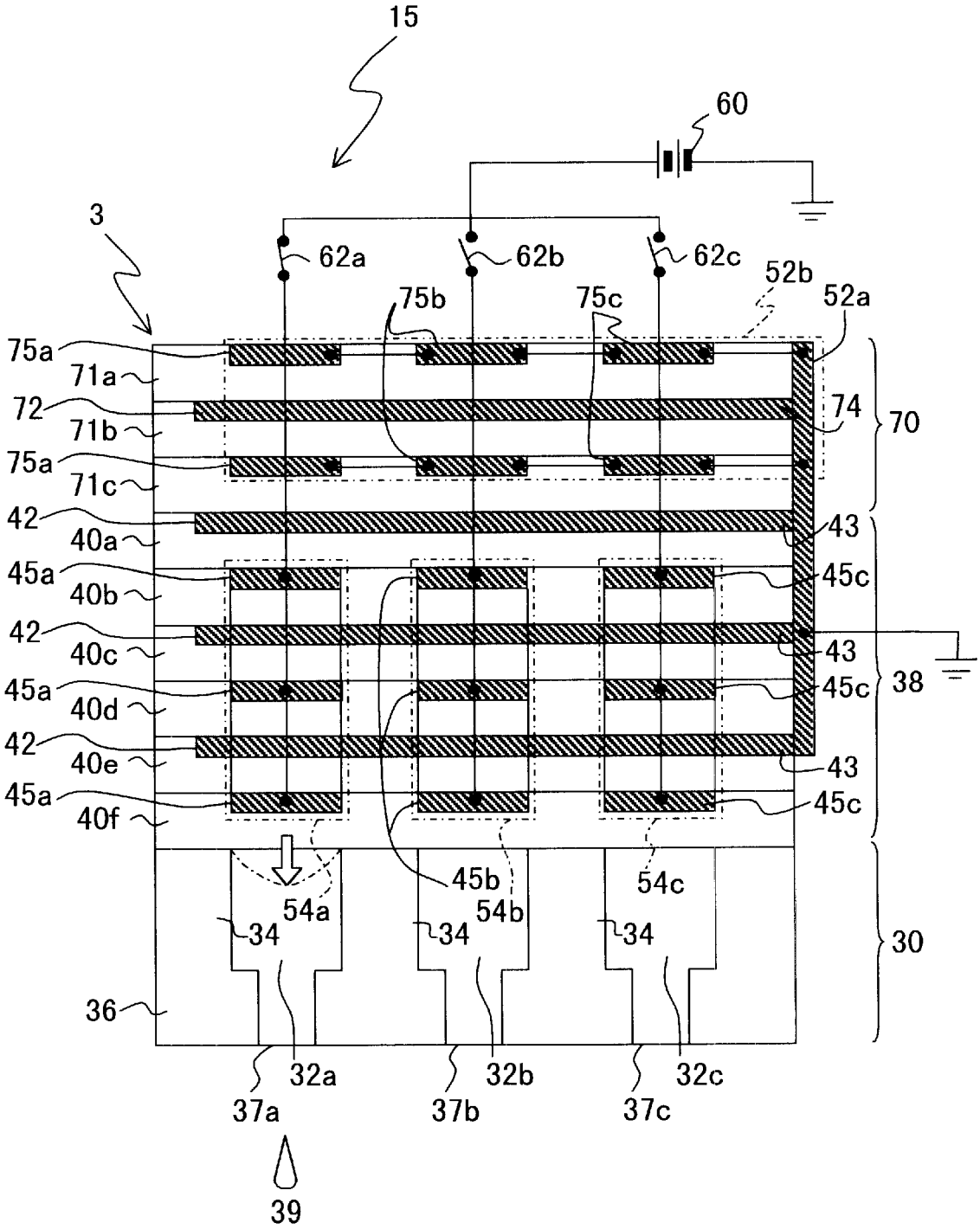
FIG. 2 is an electric connection or wiring diagram of the piezo-electric actuator of the print head.

The restraining layer 70 includes three ceramic sheets 71*a*, 71*b* and 71*c*, which are identical in structure and material and equal in size to the piezo-electric ceramic sheets 40*a*–40*f* of the active layer 38. As shown in FIGS. 1, 2 and 4, each of the top and bottom ceramic sheets 71*a* and 71*c* of the restraining layer 70 has three dummy positive electrodes 73*a*, 73*b* and 73*c* and three connectors 75*a*, 75*b* and 75*c*, which are identical in structure to the internal positive electrodes 44*a*, 44*b* and 44*c* and the connectors 45*a*, 45*b* and 45*c*, respectively, on the piezo-electric ceramic sheets 40*b*, 40*d* and 40*f*. The middle ceramic sheet 71*b* of the restraining layer 70 has a dummy negative electrode 72 and a connector 74, which are identical in structure to the internal negative electrodes 42 and the connectors 43, respectively, on the piezo-electric ceramic sheets 40*a*, 40*c* and 40*e*.

The six piezo-electric ceramic sheets 40*a*–40*f* and the three ceramic sheets 71*a*–71*c* are comprised of green sheets 50 and 51 (FIG. 4), on which electrodes etc. are printed as stated above. The green sheets 50 and 51 can be used as common parts. After the piezo-electric actuator 3 is formed, the piezo-electric ceramic sheets 40*a*–40*f* differ from the ceramic sheets 71*a*–71*c* in location, electric wiring as described later on, and function, and therefore their names differ.

The active layer 38 and the restraining layer 70 are produced by the following method.

First, ceramic powder of ferroelectric lead zirconate titanate (PZT ($PbTiO_3$.$PbZrO_3$)) material, a binder and a solvent are mixed into a mixed liquid having a viscosity between 10,000 and 30,000 CPS. The mixed liquid is spread and dried on films of polyethylene terephthalate (PET) or other plastic material to form nine green sheets, each of which has a thickness between about 22.5 and 28 microns. Five of the green sheets are used as the green sheets 50, and the other four sheets are used as the green sheets 51. Metallic material is screen-printed on those portions of the green sheets 50 which will be the internal positive electrodes 44*a*–44*c*, the dummy positive electrodes 73*a*–73*c* and the connectors 45*a*–45*c* and 75*a*–75*c*. Likewise, metallic material is screen-printed on those portions of the green sheets 51 which will be the internal negative electrodes 42, the dummy negative electrode 72 and the connectors 43 and 74.

The nine green sheets 50 and 51 are alternately stacked, with one green sheet 50 positioned at the top and another green sheet 50 positioned at the bottom. In the end, the five green sheets 50 and the four green sheets 51 of just the same structure are alternately stacked as the active layer 38 and the restraining layer 70. At this stage, the active layer 38 and the restraining layer 70 are not yet distinguished.

The stacked green sheets 50 and 51 are pressed with heat, degreased and sintered to form a piezo-electric ceramic block, which consists of the active layer 38 and restraining layer 70. The calcination of the green sheets 50 and 51 stacked as a laminated block will be explained below.

As stated already, the piezo-electric actuator 3 consists of an active layer 38 and a restraining layer 70. Electrodes are essential to the active layer 38, while the restraining layer 70 functionally needs to have no electrode. When the laminated block is sintered, however, the piezo-electric ceramics differ in shrinking percentage from the metallic material for the electrodes. Even a slight difference in shrinking percentage may warp or wave the sintered active layer 38, thereby damaging or spoiling its flatness. The non-flat active layer 38 can be bonded less closely (with lower adherence) to the cavity layer 30. This may cause a problem that ink leaks from the ink channels 32*a*–32*c*, so that defective products may be made. This may also cause a problem that the active layer 38 needs regrinding (or needs to be ground again), so that the number of producing process steps may increase and the production costs may be higher. This may further cause a problem that gaps between the layers 38 and 30 need filling with fillers, so that the strength of the laminated block may be lower.

Therefore, as stated earlier on, the restraining layer 70 and the active layer 38 are made of the same piezo-electric ceramic material so that they are equal in shrinking percentage when the ceramics are sintered. The dummy negative electrode 72, the connector 74, the dummy positive electrodes 73*a*–73*c* and the connectors 75*a*–75*c*, which are formed on the ceramic sheets 71*a*–71*c* of the restraining layer 70, are identical to the internal negative electrodes 42, connectors 43, internal positive electrodes 44*a*–44*c* and connectors 45*a*–45*c*, respectively, on the piezo-electric ceramic sheets 40*a*–40*f* of the active layer 38, but do not contribute toward deforming the restraining layer 70. Therefore, because the active layer 38 and the restraining layer 70 have the very same structure, they can be identical in shrinking percentage when they are sintered. The internal electrodes 42, 44*a*–44*c*, 72 and 73*a*–73*c* and the connectors 43, 45*a*–45*c*, 74 and 75*a*–75*c* of the layers 38 and 70 of the laminated block as a whole are arrayed in vertical symmetry (symmetrically in the directions of lamination). This symmetrizes the shrinking percentage of the whole laminated block so as not to warp this block being sintered.

With reference to FIGS. 2 and 4, the piezo-electric actuator 3 includes an external negative electrode 52*a* made of electrically conductive metallic material. This external electrode 52*a* electrically connects the connectors 43 on the three piezo-electric ceramic sheets 40*a*, 40*c* and 40*e* and the connector 74 on the ceramic sheet 71*b*. The piezo-electric actuator 3 includes another external negative electrode 52*b* made of an electrically conductive metal plate. This external electrode 52*b* electrically connects the connectors 75*a*–75*c* on the two ceramic sheets 71*a* and 71*c*. These external electrodes 52*a* and 52*b* are electrically connected. Consequently, the dummy electrodes 72 and 73*a*–73*c* on the three ceramic sheets 71*a*–71*c* and the internal negative electrodes 42 on the piezo-electric ceramic sheets 40*a*, 40*c* and 40*e* are equal in electric potential.

The piezo-electric actuator 3 also includes three external positive electrode 54*a*, 54*b* and 54*c* made of electrically conductive metallic material. The external electrode 54*a* electrically connects the connectors 45*a* on the piezo-electric ceramic sheets 40*b*, 40*d* and 40*f*. The external electrode 54*b* electrically connects the connectors 45*b* on the piezo-electric ceramic sheets 40*b*, 40*d* and 40*f*. The external electrode 54*c* electrically connects the connectors 45*c* on the piezo-electric ceramic sheets 40*b*, 40*d* and 40*f*.

The external negative and positive electrodes 52*a*, 52*b* and 54*a*–54*c* are formed out of metallic material, which is printed directly on side faces of the active layer 38 and the restraining layer 70, or with which these faces are coated directly. Alternatively, the external electrodes might be metal plates connected in contact with the connectors 43, 74, 75*a*–75*c* and 45*a*–45*c*, or wires soldered to these connectors. These electrodes might have other structures.

Because the dummy electrodes 72 and 73*a*–73*c* do not contribute toward deforming the ceramic sheets 71*a*–71*c* of the restraining layer 70, it is not necessary to apply a drive voltage to these electrodes. Even if the dummy electrodes 72 and 73*a*–73*c* and the connectors 74 and 75*a*–75*c* were insulated in order not to be electrically polarized, a potential difference might be generated between them and the top internal negative electrode 42 of the active layer 38. The potential difference produces an electric capacity, which produces an electric current. The current is so small as not to contribute toward deforming the ceramic sheets 71*a*–71*c*, but results in a power loss. In particular, if the power source for the piezo-electric actuator 3 is a battery, the power loss shortens the life of the battery. Therefore, the dummy electrodes 72 and 73*a*–73*c* and the connectors 74 and 75*a*–75*c* are connected electrically to the internal negative electrodes 42 of the active layer 38. This prevents a potential difference being generated between the dummy electrodes 72 and 73*a*–73*c* and the connectors 74 and 75*a*–75*c* of the restraining layer 70 and the top internal negative electrode 42 of the active layer 38. It is consequently possible to prevent the production of a needless capacity.

The laminated block thus constructed is then immersed in an oil bath (not shown) filled with a silicone oil or another insulating oil at a temperature of about 130 degrees C. An electric field of about 2.5 kv/mm is applied between the external negative electrode 52*a* and the external positive electrodes 54*a*–54*c* to polarize the piezo-electric ceramic sheets 40*a*–40*f* of the active layer 38.

As shown in FIG. 2, the external negative electrode 52*a* is grounded through a cord (not shown) to have a ground potential. The external positive electrodes 54*a*, 54*b* and 54*c* are connected through switches 62*a*, 62*b* and 62*c*, respectively, and a cord (not shown) to the positive pole of a power source 60, the negative pole of which is grounded. When a controller (not shown) makes one or more of the switches 62*a*–62*c* closed, a drive voltage is applied between the associated internal positive electrodes 44*a*, 44*b*, 44*c* and the internal negative electrodes 42 from the power source 60.

As shown in FIG. 5, the block consisting of the active layer 38 and the restraining layer 70, and the cavity layer 30 are assembled into the print head 15 (FIG. 6).

FIGS. 7, 8, 9 and 10 show modified piezo-electric actuators 203, 303, 403 and 503, respectively. In FIGS. 7–10, parts identical to the counterparts of the piezo-electric actuator 3 are assigned the same reference numerals without being described.

Figure 7:
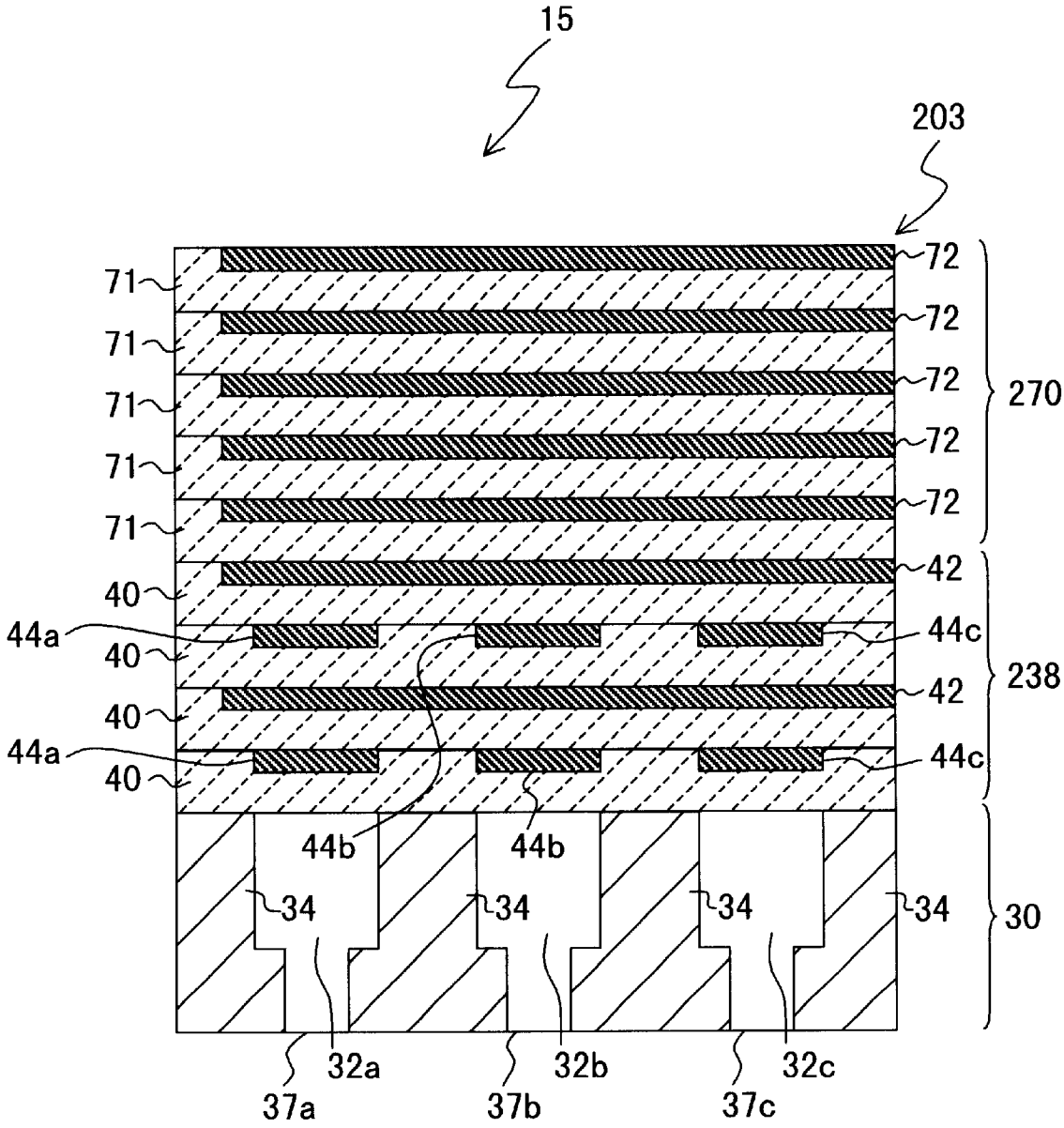
FIG. 7 is a vertical cross section of main parts of a modified print head according to the present invention.

With reference to FIG. 7, similarly to the piezo-electric actuator 3, the modified piezo-electric actuator 203 consists of an active layer 238 and a restraining layer 270. As shown in FIG. 1, the active layer 38 of the actuator 3 includes six piezo-electric ceramic sheets 40*a*–40*f*. The active layer 238 of the actuator 203 differs from the active layer 38 in including four piezo-electric ceramic sheets 40. The restraining layer 270 includes five ceramic sheets 71, on each of which a dummy negative electrode 72 is formed. Each dummy negative electrode 72 is grounded through a ground electrode. As shown in FIG. 4, the restraining layer 70 of the actuator 3 is comprised of two green sheets 50 and one green sheet 51, which are alternately stacked and sintered. As shown in FIG. 7, the restraining layer 270 of the actuator 203 differs from the restraining layer 70 in being comprised of five green sheets 51, which are stacked and sintered in such a manner that the ceramic sheets 71 and the dummy electrodes 72 are formed. The number of piezo-electric ceramic sheets 40 of the active layer 238 and the number of ceramic sheets 71 of the restraining layer 270 might vary under various conditions.

If the shrinking percentage during calcination of the electrodes provided as the dummy electrodes is within a certain range where the restraining layer 70 is prevented from warping, this layer 70 could be comprised of green sheets 51 only.

Figure 8:
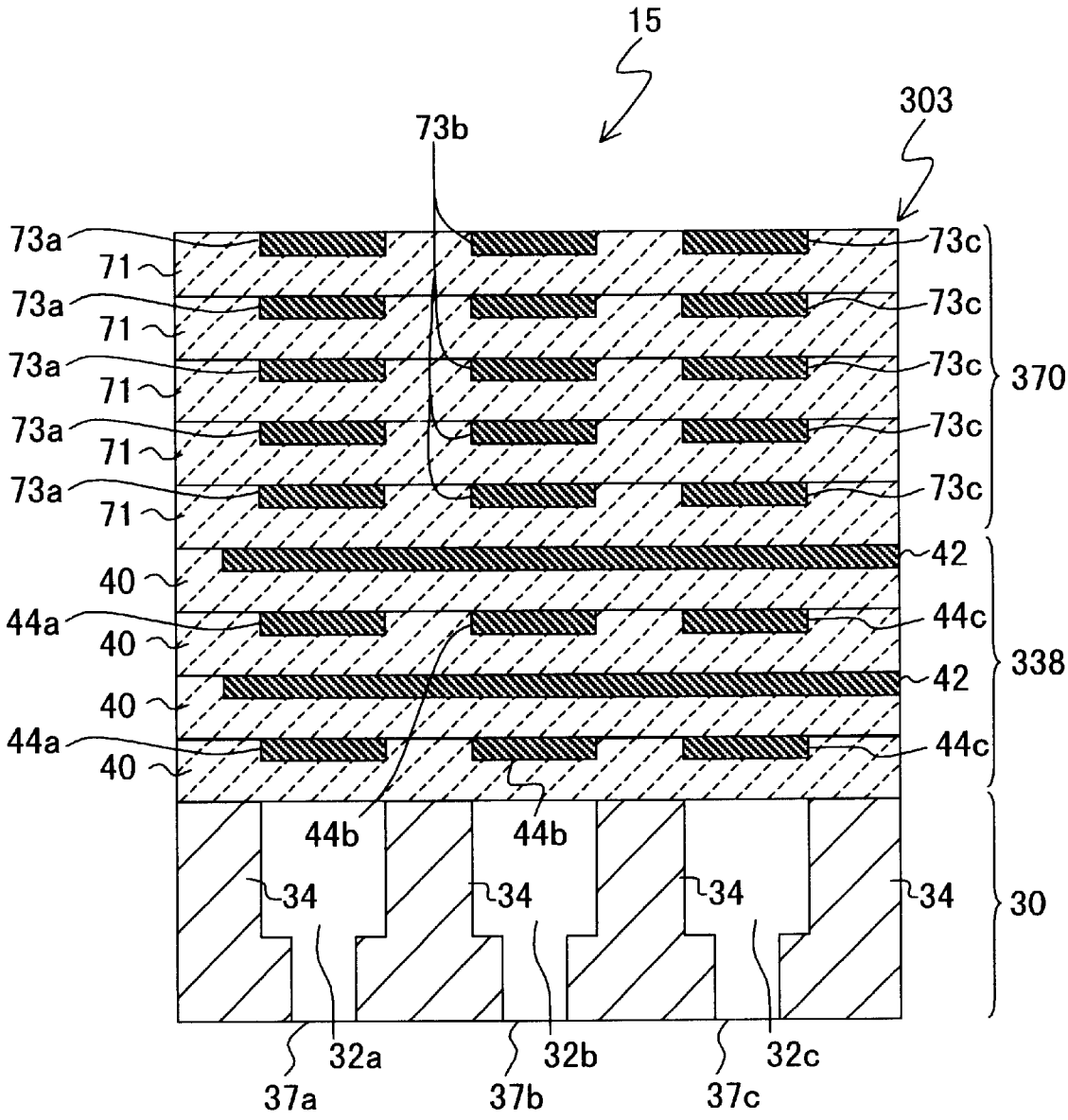
FIG. 8 is a vertical cross section of main parts of another modified print head according to the present invention.

With reference to FIG. 8, similarly to the modified piezo-electric actuator 203, the modified piezo-electric actuator 303 includes an active layer 338 including four piezo-electric ceramic sheets 40. The actuator 303 also includes a restraining layer 370 comprised of five green sheets 50, each of which has three dummy positive electrodes 73*a*, 73*b* and 73*c* formed on it. The green sheets 50 are stacked and sintered. The dummy electrodes 73*a*–73*c* are grounded through a ground electrode.

If the shrinking percentage during calcination of the dummy positive electrodes is within a certain range where the restraining layer 70 is prevented from warping, this layer 70 could be comprised of green sheets 50 only.

Figure 9:
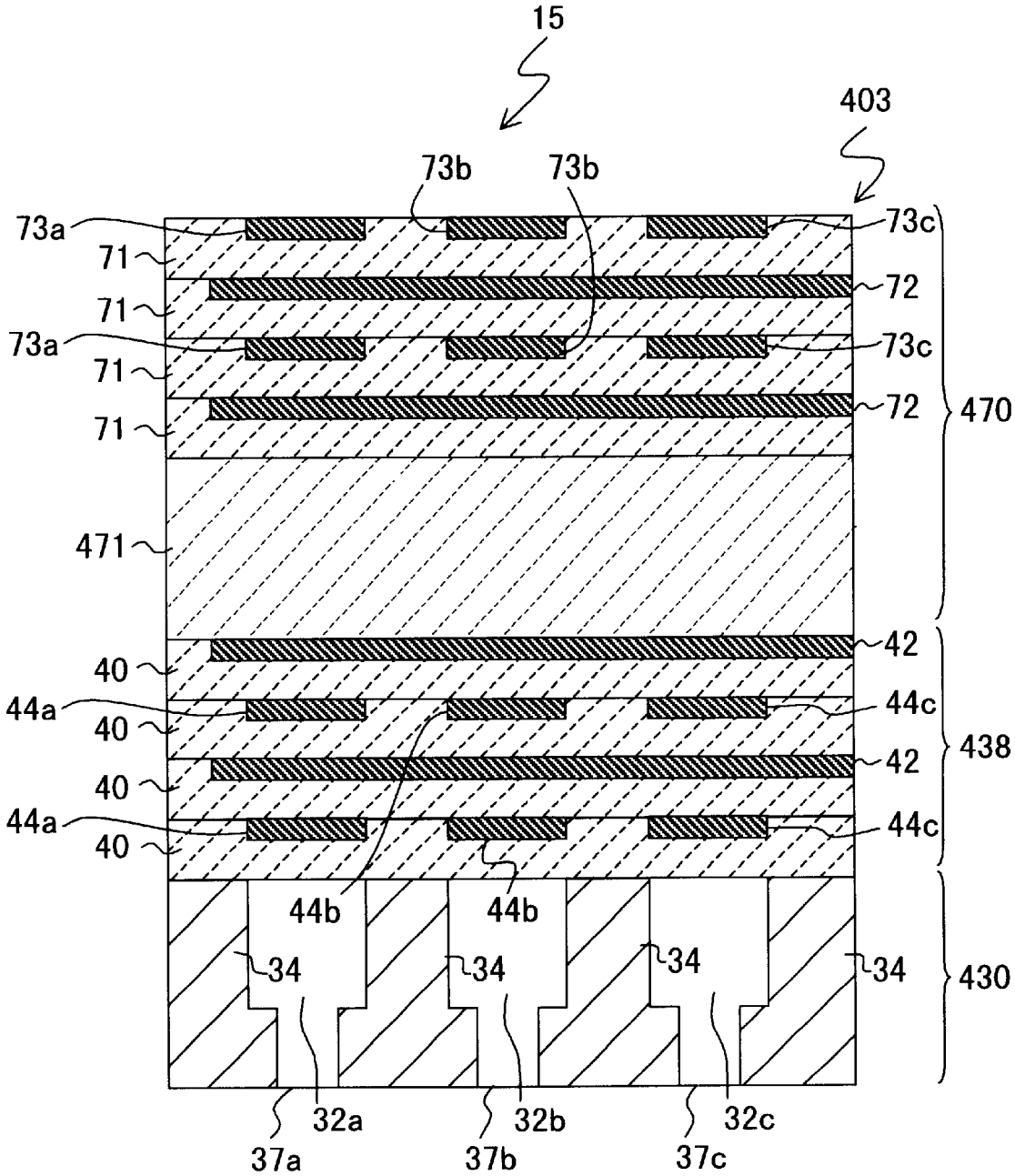
FIG. 9 is a vertical cross section of main parts of still another modified print head according to the present invention.

With reference to FIG. 9, the modified piezo-electric actuator 403 includes an active layer 438 and a restraining layer 470 similarly to the piezo-electric actuator 3, but differs from the actuator 3 because the active layer 438 includes four piezo-electric ceramic sheets 40 similarly to the active layers 238 and 338 shown in FIGS. 7 and 8, respectively. As shown in FIG. 4, the restraining layer 70 of the actuator 3 is comprised of three alternately stacked and sintered green sheets 50 and 51. The restraining layer 470 of the actuator 403 differs from the restraining layer 70 in being comprised of four stacked green sheets 50 and 51 and another green sheet which forms a ceramic sheet 471 and on which no electrode is formed. This green sheet lies under the green sheets 50 and 51. The five stacked green sheets are sintered. In other words, even though the ceramic sheet 471 without a dummy electrode forms part of the restraining layer 470, the vertically symmetric structure of the actuator 403 as a whole causes no warp due to the difference in shrinking percentage during the calcination.

Even though the ceramic sheet 471 differs in thickness from the other ceramic sheets 71 and the piezo-electric ceramic sheets 40, as shown in FIG. 9, the vertically symmetric structure of the actuator 403 as a whole causes no warp due to the difference in shrinking percentage during the calcination.

The operation of the piezo-electric actuator 3 will be described below with reference to FIGS. 1 and 2.

If the controller causes the switch 62*a*, for example, to be closed in accordance with certain print data, voltage is applied between the internal negative electrodes 42 and the internal positive electrodes 44*a*, generating electric fields in the piezo-electrically active portions 46*a* of the piezo-electric ceramic sheets 40*a*–40*f*. Consequently, the electrostrictive strain effects of the piezo-electric ceramic sheets develop force with which the active portions 46*a* tend to vertically expand. In the meantime, because no electric field is generated in the ceramic sheets 71*a*–71*c* of the restraining layer 70, these sheets do not expand nor contract. Therefore, the force with which the active portions 46*a* tend to vertically expand deforms the active layer 38 mainly downward. As indicated with an arrow in FIG. 2, the downward deformed active layer 38 reduces the volume of the ink channel 32*a*. This ejects an ink droplet 39 from the ink channel 32*a* through the orifice 37*a*. When the switch 62*a* is opened to cut off the voltage application, the piezo-electrically active portions 46*a* return to the original conditions. This enlarges the ink channel 32*a*, thereby supplying it with ink from the supply device 16 (FIG. 6) through a valve (not shown).

Without the restraining layer 70, the deformation of the piezo-electrically active portions 46*a* would deform the active layer 38 equally upward and downward. The restraining layer 70, which is highly rigid, and the active layer 38 are sintered into one piece. Even when the switch 62*a* is closed, no electric field is generated in the restraining layer 70, which does therefore not deform. Consequently, the deformation caused in the active layer 38 mainly deforms the lower side of this layer, which is adjacent to the ink channel 32*a*. Accordingly, the lower side of the piezo-electric actuator 3 can be deformed larger than that of a piezo-electric actuator without a restraining layer 70, if the piezo-electrically active portions of these actuators deform equally in amount. This makes it possible to reduce the capacity of the ink channel 32*a* and/or eject a larger amount of ink. That is to say, even with the same voltage applied, the provision of the restraining layer 70 makes it possible to eject a larger amount of ink. In other words, it is possible to eject a certain amount of ink by applying a lower voltage. This results in smaller electric power.

Figure 3:
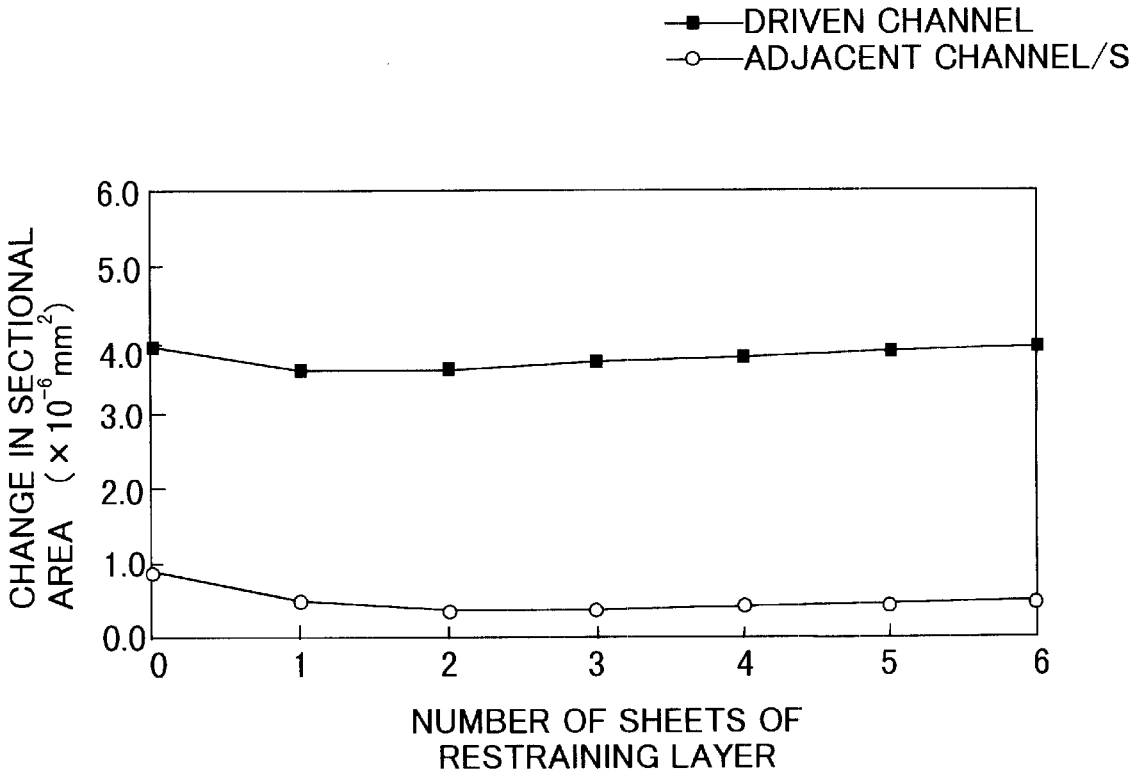
FIG. 3 is a graph of the relationship between the number of sheets of the restraining layers of the piezo-electric actuator of a print head and the change in sectional area of ink channel of the head.

The restraining layer 70 of the piezo-electric actuator 3 might be composed of two or more sheets. When the active layer 38 expands into a driven ink channel 32*a*, 32*b* or 32*c*, the driven and adjacent channels decrease or increase in sectional area. FIG. 3 shows the relationship between the number of sheets of the restraining layer 70 and the change in sectional area of the driven and adjacent channels in the case of the drive voltage being 26 volts. As shown in FIG. 3, without the sheet of the restraining layer 70, the changes in sectional area of the driven and adjacent channels were $3.910\times10^{-6}$ mm$^2$ and $0.900\times10^{-6}$ mm$^2$, respectively;

with one sheet of the restraining layer 70, the changes in sectional area of the driven and adjacent channels were $3.588\times10^{-6}$ mm$^2$ and $0.512\times10^{-6}$ mm$^2$, respectively;

with two sheets of the restraining layer 70, the changes in sectional area of the driven and adjacent channels were $3.603\times10^{-6}$ mm$^2$ and $0.391\times10^{-6}$ mm$^2$, respectively;

with three sheets of the restraining layer 70, the changes in sectional area of the driven and adjacent channels were $3.693\times10^{-6}$ mm$^2$ and $0.394\times10^{-6}$ mm$^2$, respectively;

with four sheets of the restraining layer 70, the changes in sectional area of the driven and adjacent channels were $3.784\times10^{-6}$ mm$^2$ and $0.441\times10^{-6}$ mm$^2$, respectively;

a with five sheets of the restraining layer 70, the changes in sectional area of the driven and adjacent channels were $3.859\times10^{-6}$ mm$^2$ and $0.496\times10^{-6}$ mm$^2$, respectively;

with six sheets of the restraining layer 70, the changes in sectional area of the driven and adjacent channels were $3.916\times10^{-6}$ mm$^2$ and $0.544\times10^{-6}$ mm$^2$, respectively.

As shown in FIG. 3, in the case of no restraining layer 70 being provided, it can be said that the decrease in sectional area of the driven channel 32*a*, 32*b* or 32*c* is large ($3.910\times10^{-6}$ mm$^2$), but the change in sectional area of the adjacent channel/s is large ($0.900\times10^{-6}$ mm$^2$). This large change in sectional area may cause cross talk, which lowers the SN ratio, lowering the printing quality. In this case, the decease in sectional area of the driven channel is large. However, because the rigidity of the active layer 38 is low, a portion of this layer which is positioned over the driven channel deforms laterally as well, spoiling the flatness of the active layer 38. As a result, a portion or portions of the active layer 38 which are positioned over the adjacent channel/s deform upward, and the wall between the driven channel and the adjacent channel or each of the adjacent channels deforms toward the driven channel, increasing the sectional area of the adjacent channel/s.

In the case of the sheet of the restraining layer 70 being one in number, the portion of the active layer 38 which is positioned over the driven channel 32*a*, 32*b* or 32*c* is restrained from deforming. In this case, the change in sectional area of the driven channel decreases once to $3.588\times10^{-6}$ mm$^2$, and the change in sectional area of the adjacent channel/s decreases to $0.512\times10^{-6}$ mm$^2$. Because the rigidity of the piezo-electric actuator 3 is low, however, the deformation of the adjacent channel/s is still large, and therefore the SN ratio is still relatively high.

In the case of the sheets of restraining layer 70 being two in number, their total rigidity is higher, so that the deformation of the upper side of the active layer 38, which is adjacent to the restraining layer 70, is smaller, making the piezo-electric actuator 3 more rigid. In this case, the deformation of the adjacent channel/s 32*a*, 32*b*, 32*c* is $0.391\times10^{-6}$ mm$^2$, which is the smallest. Meanwhile, the deformation of the active layer 38 is efficiently transmitted toward the driven channel 32*a*, 32*b* or 32*c*, so that the change in sectional area of this channel increases to $3.603\times10^{-6}$ mm$^2$. Because the change in sectional area of the adjacent channel/s is sufficiently small, and the change in sectional area of the driven channel is larger, the SN ratio is improved and therefore the printing quality is improved.

In the case of the sheets of the restraining layer 70 being three or more in number, the deformation of the piezo-electrically active portions 46*a*, 46*b* or 46*c* associated with the driven channel 32*a*, 32*b* or 32*c* is transmitted more efficiently toward this channel, and the change in sectional area of the adjacent channel/s is not large. This maintains a suitable SN ratio.

From the foregoing results, it has been concluded that, for a suitable SN ratio and simple structure of the piezo-electric actuator 3, the optimum sheet number of restraining layer 70 is three.

Of course, the requirements for the optimum restraining layer 70 vary with the number of sheets and thickness of active layer 38, the material, the drive voltage, the capacity of the ink channels 32*a*–32*c*, the amount of ejected ink, and other conditions. One of the requirements for the optimum restraining layer 70 is that this layer should make the actuator 3 rigid to such a degree that irregular deformation cannot uselessly deform the ink channel or channels adjacent to a driven ink channel 32*a*, 32*b* or 32*c*. The other requirement is that the restraining layer 70 should be rigid so that the deformation of the piezo-electrically active portions 46*a*–46*c* of the active layer 38 can be transmitted efficiently toward the ink channels 32*a*–32*c*.

As stated already, the restraining layer 70 is formed on the top of the active layer 38 integrally with this layer, under which the ink channels 32*a*–32*c* are formed. The restraining layer 70 restrains the deformation of the active layer 38. This makes it possible to efficiently utilize the deformation of the active layer 38 to change the volume of the ink channels 32*a*–32*c*. It is therefore possible to improve the ink ejecting performance of the print head 15 and reduce power consumption. It is also possible to prevent horizontal or lateral deformation to restrain the volume change of the ink channel or channels adjacent to a driven ink channel 32*a*, 32*b* or 32*c*, preventing cross talk. The active layer 38 and the restraining layer 70 are formed by being integrally sintered. Accordingly, in comparison with a piezo-electric actuator having a deformation restraining member stuck with an adhesive or the like, the actuator 3 can be produced at a low cost by a simple process including a reduced number of steps, and its strength can be high.

The active layer 38 and the restraining layer 70 are made of the same ceramic material. Therefore, green sheets 50 and 51 for the active layer 38 can be used as they are for the restraining layer 70. This makes it possible to produce the piezo-electric actuator 3 simply at a lower cost. The same material makes the layers 38 and 70 fit together, and prevents them from being warped, distorted or deformed, when they are integrally sintered. This results in high accuracy or precision.

The restraining layer 70 includes dummy electrodes 72 and 73*a*–73*c* and connectors 74 and 75*a*–75*c*, which do not contribute to the deformation for driving the ink channels 32*a*–32*c*. Therefore, when the active layer 38 and the restraining layer 70 are integrally sintered, it is possible to equalize the differences in shrinking percentage in the vertical directions to prevent warps and/or waves due to the difference in shrinking percentage between the layers 38 and 70. This can made the piezo-electric actuator 3 very flat.

Consequently, the actuator 3 can be bonded closely to the cavity layer 30. This results in high accuracy or precision.

In particular, the internal electrodes 42 and 44*a*–44*c*, connectors 43 and 45*a*–45*c*, dummy electrodes 72 and 73*a*–73*c* and connectors 74 and 75*a*–75*c* are arranged roughly in vertical symmetry in the active layer 38 and restraining layer 70. Therefore, when these layers 38 and 70 are integrally sintered, it is possible to roughly equalize the differences in shrinking percentage in the vertical directions to prevent warps and/or waves due to the difference in shrinking percentage between the layers 38 and 70. This can make the piezo-electric actuator 3 even flatter.

The dummy electrodes 72 and 73*a*–73*c* and the connectors 74 and 75*a*–75*c* of the restraining layer 70 face the internal electrodes 42 and 44*a*–44*c* and the connectors 43 and 45*a*–45*c* of the active layer 38 through the ceramics, which are dielectrics, etc. The dummy electrodes and the connectors of the restraining layer 70 are connected electrically to the internal negative electrodes 42 of the active layer 38. Consequently, there is no potential difference between the dummy electrodes and the connectors of the restraining layer 70 and the internal electrodes and the connectors of the active layer 30, producing no electric capacity between them. As a result, no electric power is wasted.

The method for producing the piezo-electric actuator 3 in accordance with the present invention involves forming the active layer 38 and the restraining layer 70 by calcining them. The restraining layer 70 restrains the active layer 38 from deforming away from the ink channels 32*a*–32*c*. It is therefore possible to efficiently utilize the deformation of the active layer 38 to change the volume of the ink channels 32*a*–32*c*. This makes it possible to improve the ink ejecting performance of the print head and reduce power consumption. It is also possible to prevent the horizontal or lateral deformation of the active layer 38 to restrain the volume change of the ink channel or channels adjacent to a driven ink channel 32*a*, 32*b* or 32*c*, preventing cross talk. In particular, the active layer 38 and the restraining layer 70 are formed by being integrally sintered. Accordingly, in comparison with the case where a deformation restraining member is stuck with an adhesive or the like, the actuator 3 can be produced at a low cost by a simple process including a reduced number of steps, and its strength can be high.

Figure 10:
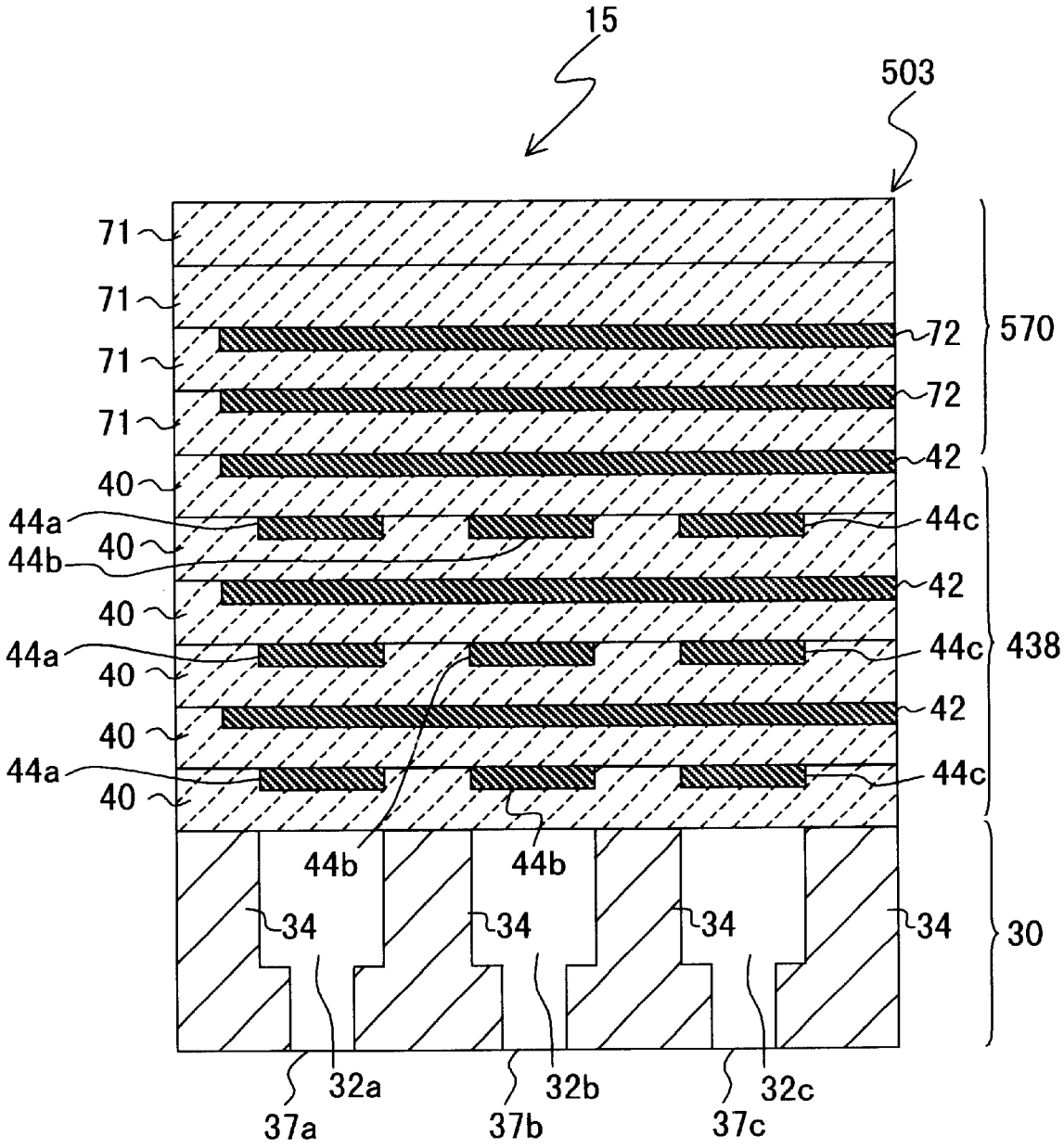
FIG. 10 is a vertical cross section of main parts of yet another modified print head according to the present invention.
Figure 11:
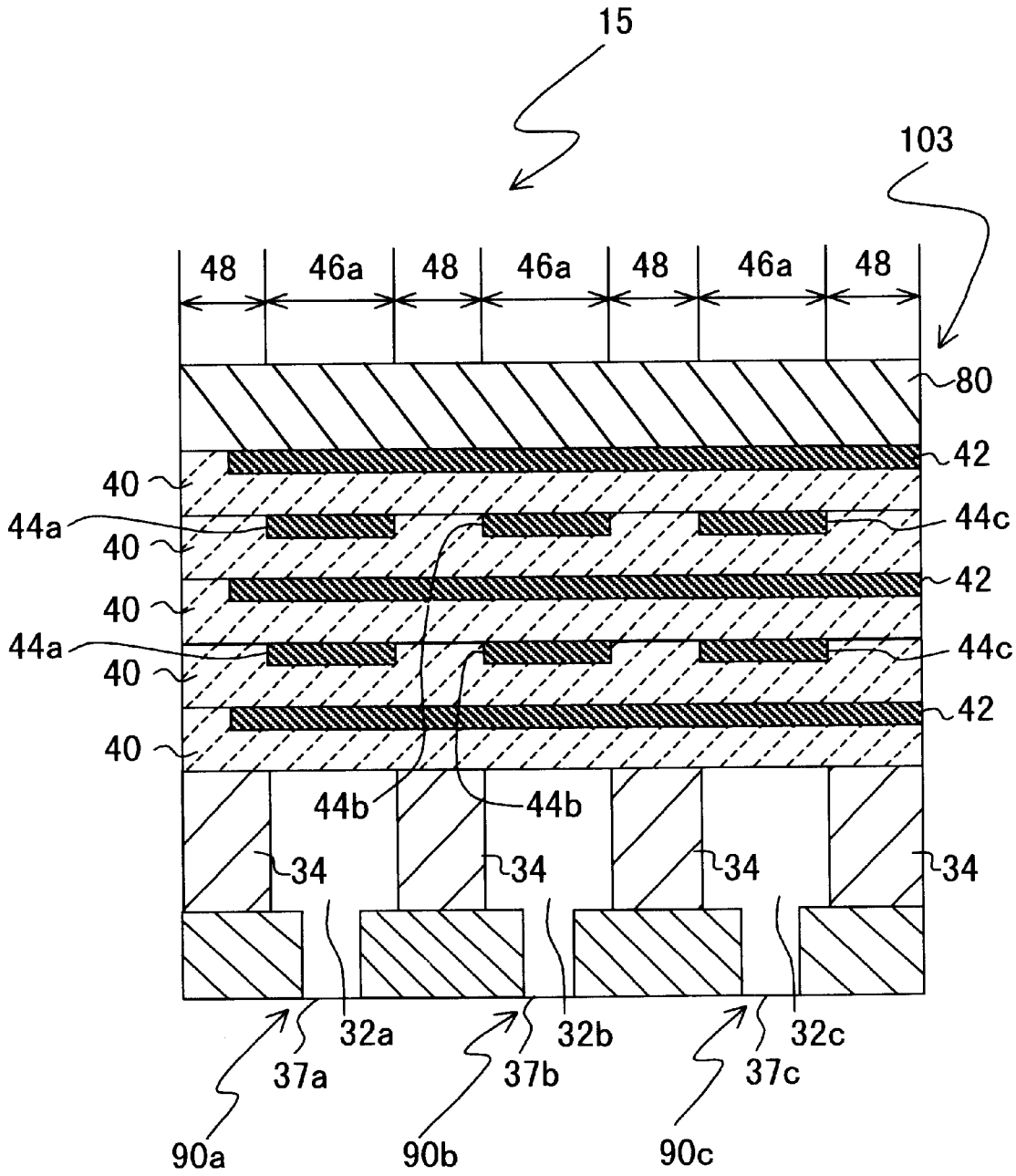
Fig. 11 PRIOR ART
FIG. 11 is a vertical cross section of main parts of the print head of a conventional ink jet printer.

With reference to FIG. 10, similarly to the piezo-electric actuator 3, the modified piezo-electric actuator 503 consists of an active layer 438 and a restraining layer 570. The active layer 438 includes six piezo-electric ceramic sheets 40. The restraining layer 570 includes four ceramic sheets 71. Each of the two lower ceramic sheets 71 has a dummy negative electrode 72 formed on its upper side. The two upper ceramic sheets 71 have no dummy negative electrode, and can prevent the actuator 503 from deforming due to the provision of the dummy electrodes 72 on the respective lower ceramic sheets 71. If ceramic sheets having no electrode and large in volume were present adjacently to the internal negative electrodes 42 of the active layer 438, these negative electrodes 42 would diffuse or spread while the layers 438 and 570 are sintered. Because the dummy negative electrodes 72 are formed on the upper sides of the lower ceramic sheets 71 of the restraining layer 570, as stated above, the internal negative electrodes 42 can be prevented from diffusing while the layers 438 and 570 are sintered.

The present invention has been described hereinbefore on the basis of the preferred embodiments, but is not limited to them. It would be obvious that various modifications and/or improvements can be made without departing from the spirit of the present invention.

What is claimed is:

1. A piezo-electric actuator for an ink jet printer head which has an ink channel with a certain volume and an orifice, and which ejects ink from the channel through the orifice by changing the volume of the channel, the actuator comprising:

an active layer one side of which faces the ink channel, the active layer including at least one first sheet formed out of piezo-electric material, the first sheet being provided with an electrode thereon; and a restraining layer which is positioned on the other side of the active layer and restrains the active layer from deforming, the restraining layer including at least one second sheet provided with a dummy electrode.

2. The piezo-electric actuator defined in claim 1, wherein the first and second sheets are formed out of the same material.

3. The piezo-electric actuator defined in claim 1, wherein the dummy electrode of the restraining layer is connected to the electrode of the active layer.

4. The piezo-electric actuator define in claim 1, wherein the dummy electrode of the restraining layer and the electrode of the active layer are positioned in substantial symmetry in the actuator.

5. A piezo-electric actuator for an ink jet printer head, comprising:

a laminate including a plurality of piezo-electric sheets stacked and sintered at the same time; and an electrode formed on at least one of the sheets which is positioned on one side of the laminate;

only the at least one sheet being activated with a drive voltage, while at least one of the sheets which is positioned on the other side of the laminate is deactivated, wherein said at least one sheet on said other side is provided with a dummy electrode.

6. The piezo-electric actuator defined in claim 5, wherein the print head has an ink channel facing the one side.

7. The piezo-electric actuator defined in claim 5, wherein said at least one sheet on said other side restrains said at least one sheet on the one side from deforming due to the activation thereof.

8. The piezo-electric actuator defined in claim 5, wherein the dummy electrode is connected to the electrode on said at least one sheet on said one side.

9. The piezo-electric actuator defined in claim 5, wherein the dummy electrode is positioned at the at least one sheet on the other side in an equivalent arrangement to the electrode on the at least one sheet on said one side.

10. An ink jet printer head comprising:

an ink ejector having an ink channel formed therein and an orifice through which ink is ejected from the channel and a piezo-electric actuator for changing the volume of the ink channel, the actuator including:

an active layer one side of which faces the ink channel, the active layer including at least one first sheet formed out of piezo-electric material, the first sheet being provided with an electrode thereon; and a restraining layer which is positioned on the other side of the active layer and restrains the active layer from deforming, the restraining layer including at least one second sheet provided with a dummy electrode.

11. The ink jet printer head defined in claim 10, wherein the first and second sheets are formed out of the same material.

* * * * *